United States Patent [19]

Morizot

[11] 4,413,208

[45] Nov. 1, 1983

[54] HIGH GAIN CROSSED FIELD AMPLIFIER TUBE AND RADIO TRANSMISSION SYSTEM EQUIPPED WITH SUCH A TUBE

[75] Inventor: Jean Paul Morizot, Paris, France

[73] Assignee: Thomson-CSF, Paris, France

[21] Appl. No.: 279,198

[22] Filed: Jun. 30, 1981

[30] Foreign Application Priority Data

Jul. 1, 1980 [FR] France ..... 80 14626

[51] Int. Cl.[3] ..... H01J 25/34

[52] U.S. Cl. ..... 315/39.3; 315/3.6; 330/43

[58] Field of Search ..... 315/39.3, 3.6; 330/43

[56] References Cited

U.S. PATENT DOCUMENTS

| | | | |
|---|---|---|---|
| 2,794,936 | 6/1957 | Huber | 315/3.6 |
| 2,925,521 | 2/1960 | Dench | 315/3.6 |
| 2,942,142 | 6/1960 | Dench | 315/39.3 |
| 3,046,443 | 7/1962 | Dench | 315/3.6 |
| 3,123,735 | 3/1964 | Hull | 315/3.6 |
| 3,448,330 | 6/1969 | Farney | 315/3.6 |
| 3,508,110 | 4/1970 | Farney | 315/3.6 |
| 4,087,718 | 5/1978 | Farney | 315/3.6 |

OTHER PUBLICATIONS

Archiv fur Elektronik und Ubertragungs-Technik, vol. 27, No. 2, Feb. 1973, Stuttgart, Germany.

G. Kowalski: "Delay Equalization by Tapered Meander Lines", pp. 65-69.

*Primary Examiner*—Saxfield Chatmon

*Attorney, Agent, or Firm*—Roland Plottel

[57] ABSTRACT

The invention relates to a high gain crossed field amplifier tube.

Such a tube comprises in a vacuum enclosure 1 a cathode 2 and a delay line 3, itself constituted by an input line 31 whose height is less than that of the output line 32.

The invention is applied to radio transmission systems.

5 Claims, 5 Drawing Figures

FIG_2-a
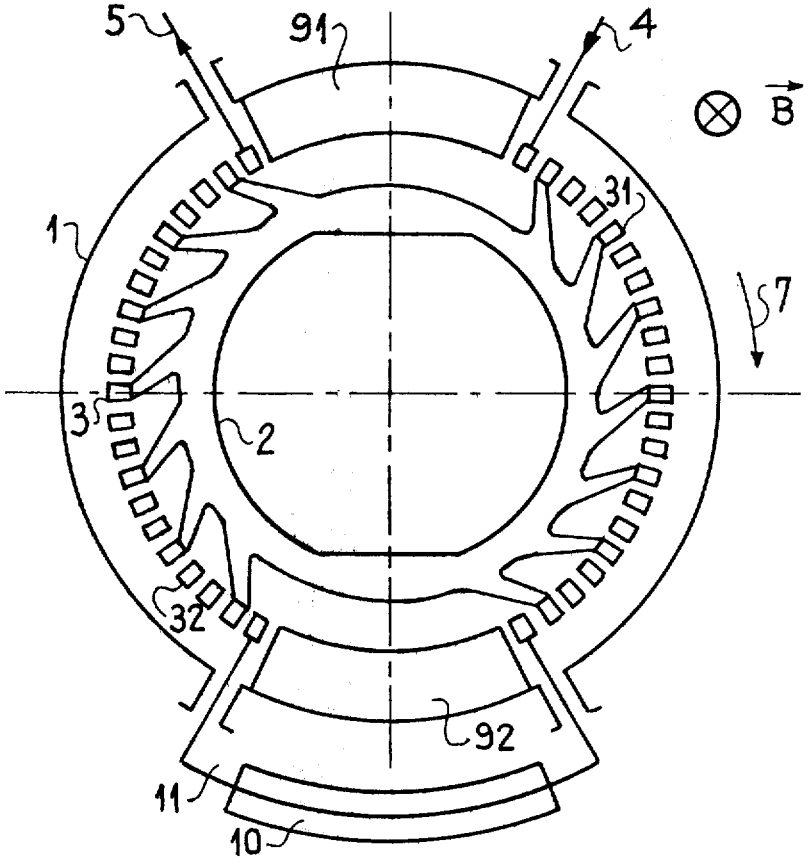
FIG_2-b
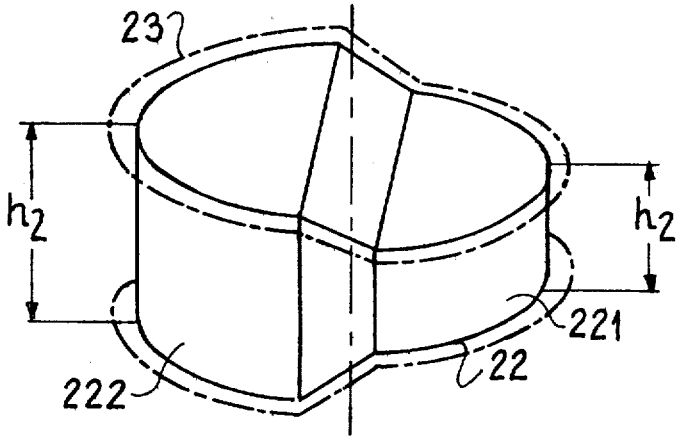

HIGH GAIN CROSSED FIELD AMPLIFIER TUBE AND RADIO TRANSMISSION SYSTEM EQUIPPED WITH SUCH A TUBE

BACKGROUND OF THE INVENTION

The present invention relates to a high gain crossed field amplifier tube.

Crossed field amplifier tubes are generally used in the power stage of radar transmitters. The invention also relates to radio transmission systems equipped with such a tube.

These tubes are essentially constituted by two cylindrical, concentric electrodes placed under vacuum between which a potential difference is produced, which creates a d.c. field $E_o$. A magnetic field B is applied parallel to the tube axis and therefore perpendicular to the electric field.

The internal electrode is a cathode forming an electron current source. The external electrode is a delay line, whose function is to propagate the high frequency wave with a phase velocity $V_\phi$ of the order of a fraction of the speed of light.

Under the interconnected actions of the electric field and the magnetic field, the electrons from the cathode follow cycloidal trajectories with an average azimuth speed $V_e$.

It has been shown that the amplification of the high frequency power occurs when $V_e = V_\phi$. A distinction is made between crossed field tubes with a forward or backward wave, as a function of whether the high frequency energy flows in the direction of the electron beam or in the reverse direction. The gain of crossed field amplifiers is given by the expression $g = 10\log(Ps/Pe)$.

Increasing the gain means decreasing the input lower Pe or increasing the output power Ps. In connection with the first solution there is a minimum value of Pe below which the tube does not operate because the power is insufficient for creating the first space charge branch. This value is dependent on the geometrical characteristics of the delay line, electrical and magnetic characteristics and the secondary emission coefficient of the cathode.

If Pe is equal to the minimum Pe the gain can reach 18 dB, but in this case the signal to noise ratio is too low (<20 dB). To bring this ratio to an acceptable value (approximately 40 dB) it is necessary to slightly increase the input power. In this case the value of the gain hardly exceeds 13 dB.

Another way to increase the gain is to increase the output power Ps, which is given by the relation $Ps = \eta.I.Uc$, $\eta$ being the overall efficiency of the tube which is approximately 50%.

The output power Ps is consequently essentially proportional to the electron current I, the operating voltage Uc varying only very slightly with the current. The total current I is proportional to the number N of space charge branches, each branch transmitting a current substantially equal to I/N.

If an attempt is made to increase the gain of a crossed field amplifier by doubling, for example, the length of the line the improvement is at the most 3 dB. Thus, this operation is ineffective and can lead to a lack of stability, because the interfering modes are sensitive to the line length.

On attempting to obtain the same result by increasing the operating current so as to double the total current, there is a multiplication by two of the current transmitted in each space charge branch, including the first and it is necessary to increase the input power in the same proportions for stabilizing said branch. Thus, it is not advantageous to increase the gain in this way.

BRIEF SUMMARY OF THE INVENTION

The present invention proposes to increase the gain of crossed field amplifiers by reducing the value of the current transmitted by the first space charge arm with the object of proportionally reducing the high frequency power necessary for the formation and for the stabilization of said branch. To this end the structure of the delay line is modified to reduce the current calculated level with the high frequency input.

Therefore the present invention relates to a crossed field amplifier tube comprising in a vacuum space a cylindrical cathode and a delay line concentric thereto and which faces it over its entire height, said tube also comprising an input located at one of the ends of the line and an output located at the other end and separated by a degrouping space, said line receiving by said input the signal to the amplified and supplying by said output the amplified signal, wherein the height of the delay line is less at the input than at the output.

BRIEF DESCRIPTION OF THE DRAWINGS

The invention is described in greater detail hereinafter relative to non-limitative embodiments and with reference to the attached drawings, wherein show:

FIG. 2*a* a cross-sectional view of a crossed field amplifier tube according to the invention in the case of a tube with two uniform delay lines.

FIG. 2*b* an example of a cathode used in the case of a tube with two uniform delay lines.

DETAILED DESCRIPTION OF THE PREFERRED EMBODIMENTS

Figure 1:
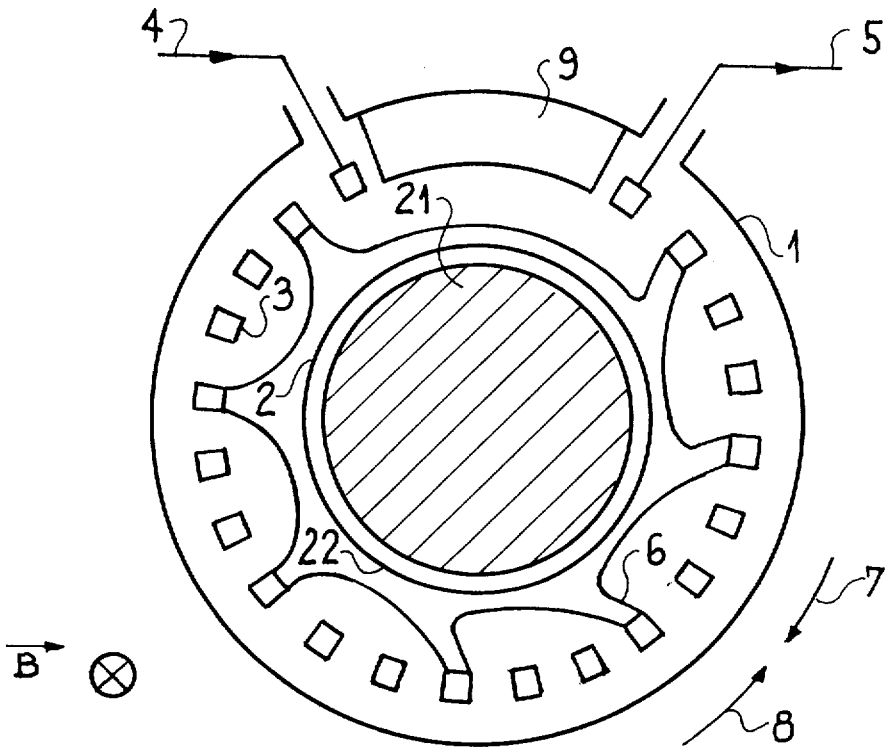
PRIOR ART FIG 1
FIG. 1 a cross-sectional view of a prior art crossed field amplifier tube.

FIG. 1 is a cross-sectional view of a crossed field amplifier tube according to the prior art having a cylindrical structure. It comprises two concentric electrodes 2 and 3 in a vacuum enclosure 1. A not shown d.c. source produces an electric field Eo between the electrodes.

The positive electrode 3 is constituted by a delay line having a periodic structure with a series of fingers having a constant pitch. They face the negative electrode or cathode 2, which is itself constituted by a molybdenum support 21, covered by e.g. an impregnated tungsten emissive part 22.

Two connections 4 and 5 are provided on the delay line for the entry and exit of the high frequency wave and they are separated from one another by a degrouping space 9. A magnetic field B is produced in a plane perpendicular to the drawing.

The tube shown in FIG. 1 is an amplifier with electron emission distributed by a cathode 2 and whose space charge branches are represented by reference numeral 6. It is a backward wave tube because the electron beam rotates in the direction indicated by arrow 7, which is the opposite to that of the electromagnetic energy flowing in the direction of arrow 8.

FIG. 2*a* is a cross-sectional view of a crossed field amplifier tube according to the invention in the case of a tube with two uniform delay lines and forward or direct transmission.

If the characteristic current $I_{01}$ calculated at the level of the HF input is less than that of $I_{02}$ calculated at the HF output, the corresponding power gain increase is substantially equal to 10 log (I01/I02).

It is pointed out that the characteristic current Io is given by the formula:

$$Io = \frac{m}{e} \frac{V_\phi 3}{ra^4} \frac{2\pi\epsilon o_h}{\left[1 - \left(\frac{rc}{ra}\right)^2\right] 2\left[\frac{ra}{rc} + 1\right]} \quad (1)$$

Thus, the characteristic current $I_0$ is always very close to the operating current, the ratio I/I0 being between 0.3 and 1.2. Formula (1) shows that the characteristic current $I_0$ is dependent on the following geometrical parameters:

h: common width of the delay line and the cathode, ra: radius of the anode (delay line and degrouping space), rc: radius of the cathode, as well as the phase velocity of the wave along the delay line, which is itself dependent on the pitch of said line.

According to the invention the characteristic current is reduced at the level of the first branch of the space charge and consequently reducing the dimensions of the delay line of this point. Now, any modification in the delay line leads to variations in the phase velocity $V_\phi$ of the wave. Thus, as it is necessary to maintain the synchronism $Ve = V_\phi$ and $ve = (Eo/B)$ applies, Eo being the d.c. field, it is therefore necessary to additionally vary the magnetic field B applied along the delay line.

The crossed field amplifier tube according to the invention shown in FIG. 2*a* differs from the prior art crossed field amplifier tube by the fact that it comprises two delay lines of different dimensions in series, but which are uniform and separated by two degrouping spaces 91 and 92.

The first line 31 has a width $h_1$, which is less than the width $h_2$ of the second line 32, $h_1$ and $h_2$ being chosen in such a way that the average transmitted powers can, for example, be in a ratio of 20, corresponding to a gain increase of 13 dB.

The magnetic field is stronger on input line 31 than an output line 32. The appropriate pole pieces are used for obtaining the desired result.

The second degrouping space 12 makes it possible to separate the two delay lines. The effect of this space is to prevent spurious oscillations from propagating in the electron beam.

The HF power is transmitted to the input of delay line 32 by a connection 11 located within the vacuum enclosure 1. This connection can advantageously be constituted by a wave guide containing a ferrite. All of these are placed in the magnetic field of the tube and form an insulator, which absorbs the power reflected by the output line.

By means of this device it is possible to obtain gains of approximately 26 dB. Beyond this value it would be more difficult to obtain an adequate decoupling between the HF input and the HF output.

The aforementioned tube uses forward transmission, but similar results can be obtained with backward transmission tubes.

The invention is also applicable to the case of crossed field amplifier tubes containing a forward leakage line and a backward leakage line, in series with the first mentioned line.

The advantage of such a device is that the facing HF inputs and outputs have HF powers which only differ by 13 dB, although the gain of the system is 26 dB. Thus, the tube would have little tendency to oscillate by direct coupling between the two ends of the line. However, it could oscillate on the output standing wave ratio and it would also be necessary to incorporate a ferrite between the input line output and the output line input.

FIG. 2*b* shows an example of a cathode used in the case of a tube with two uniform delay lines. Such a cathode is constituted by a molybdenum support covered by an e.g. impregnated tungsten emissive part 22, provided with negatively polarized deflectors 23 serving to focus the electron beam.

Only the emissive parts have the variable shape adopted by the delay line. The emissive 221 facing the input line has a height h1 which is less than the height h2 of the emissive part 222 facing the output line, h1 and h2 being respectively equal to the widths of the input line and the output line.

Figure 3:
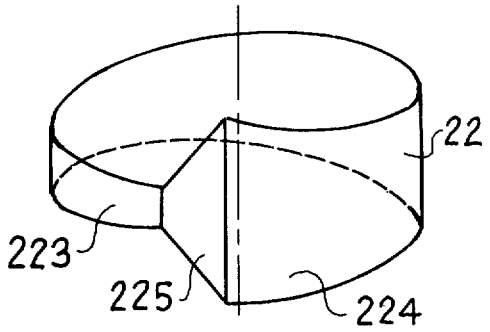
FIG. 3 an example of a cathode used in the case of a tube with a continually variable delay line.

FIG. 3 shows an example of a cathode used in the case of a tube with a continually variable delay line. In such a tube four parameters are varied between the HF input and the HF output, namely:

height h which is common to the cathode and the delay line, the cathode-line d spacing, the delay constant $c/V_{100}$ (i.e. the pitch of line p), the magnetic field B.

The variation of these parameters is chosen in such a way that the current transmitted by the space charge branch varies e.g. in a ratio of 20 between the HF input and the HF output.

The cathode of a continually variable delay line tube shown in FIG. 3 has an emissive part 22 whose height continually increases from the HF input to the HF output. The emissive part 225 facing the degrouping space ensures the continuity between parts 223 and 224.

Figure 4:
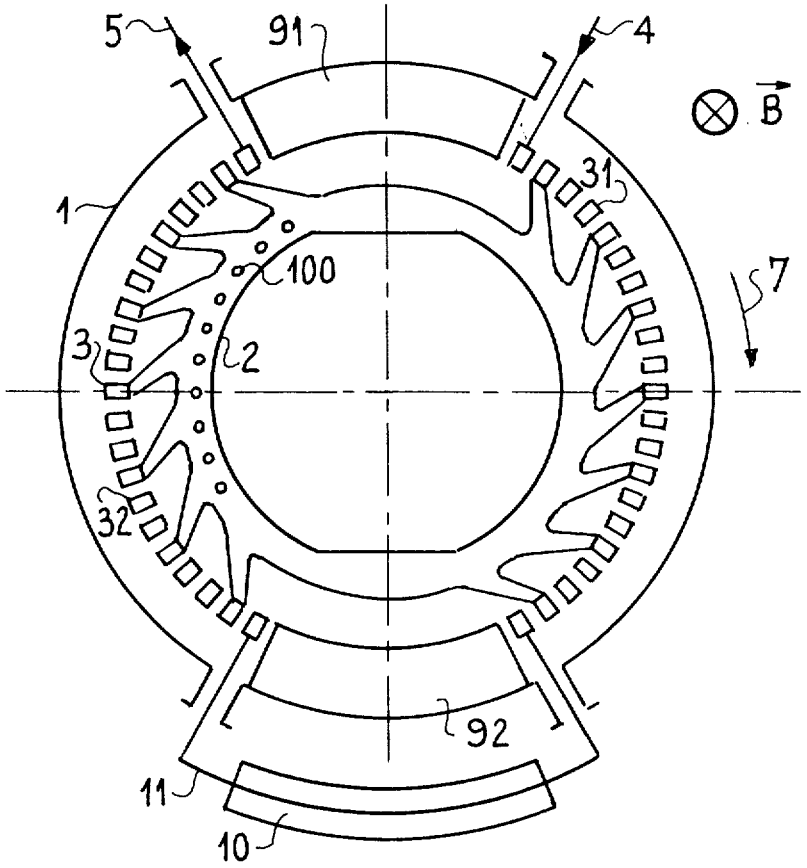
FIG. 4 a cross-sectional view of an example of a crossed field amplifier tube according to the invention, in the case of a tube with two operating modes.

FIG. 4 is a cross-sectional view of an embodiment of a crossed field amplifier tube according to the invention in the case of a tube with two operating modes. By adding a grid 100 to the tube, e.g. with two forward transmission lines, facing output line 32, a tube with two operating modes is obtained.

This grid, which is electrically insulated from cathode 2, can be negatively polarized relative to the latter (−Vg). There is no need to completely block the current, it merely being a question of adequately reducing the cathode emission to reduce the tube gain by 10 dB, whilst retaining the resistance of the beam.

Two operating modes are obtained for a given input power Po:

$$Vg = 0 \text{ peak output power: } Po + 26 \text{ dB} \quad (1)$$

$$Vg \neq 0 \text{ peak output power: } Po + 16 \text{ dB} \quad (2)$$

In the second mode and in the case of pulsed operation it is possible to increase the repetition frequency so as to equal out the average power of the first mode.

The grid can be formed by pyrolitic carbon bars connected to the same potential. It covers all or part of the cathode surface facing the output line.

It cannot be placed in front of input line 3, because that would decrease the power available at the input of the output line, which could prevent the formation of the space charge branch.

What is claimed is:

1. A crossed field amplifier tube comprising in a vacuum space a cylindrical cathode a delay line concentric thereto and which faces it over its entire height, a magnetic field parallel to the axis of the cathode being provided in the annular interaction region between the cathode and the delay line an input for receiving the signal to be amplified located at one of the ends of the line, and an output for supplying the amplified signal located at the other end, the output and the input being separated by a degrouping space wherein the common width of the delay line and the cathode parallel to the magnetic field is less at the input than at the output and at least one of the other parameters of the amplifier tube, such as the magnetic field, the cathode-line spacing, the pitch of the line is modified to maintain the synchronism $V_\phi = V_e$ wherein $V_{100}$ is the phase velocity and $V_e$ is the average azimuth speed.

2. A crossed field amplifier tube according to claim 1, wherein the delay line is interrupted over a fraction of its width and is constituted by two electrically interconnected portions of different heights.

3. A crossed field amplifier tube according to claim 1, wherein the delay line has a continually variable height from the input to the output.

4. A crossed field amplifier tube comprising a delay line according to claim 1 and also comprising a grid positioned between the cathode and the delay line in the final part of the tube.

5. A radio transmission system, wherein it comprises a crossed field amplifier tube according to one of the claims 2 to 4 or 1.

* * * * *